US010368602B2

(12) United States Patent
Dodson

(10) Patent No.: US 10,368,602 B2
(45) Date of Patent: Aug. 6, 2019

(54) PROTECTIVE HELMET

(71) Applicant: Intelligent Cranium Helmets, LLC., Woodbridge, VA (US)

(72) Inventor: Ambrose Jerel Dodson, Woodbridge, VA (US)

(73) Assignee: Intelligent Cranium Helmets, LLC, Woodbridge, VA (US)

( * ) Notice: Subject to any disclaimer, the term of this patent is extended or adjusted under 35 U.S.C. 154(b) by 618 days.

(21) Appl. No.: 15/140,215

(22) Filed: Apr. 27, 2016

(65) Prior Publication Data

US 2016/0309827 A1 Oct. 27, 2016

Related U.S. Application Data

(60) Provisional application No. 62/153,075, filed on Apr. 27, 2015, provisional application No. 62/264,738, filed on Dec. 8, 2015.

(51) Int. Cl.

| | |
|---|---|
| ***A42B 3/04*** | (2006.01) |
| ***A42B 3/30*** | (2006.01) |
| ***G08B 25/01*** | (2006.01) |

(52) U.S. Cl.

CPC ..... *A42B 3/0426* (2013.01); *A42B 3/046* (2013.01); *A42B 3/30* (2013.01); *G08B 25/016* (2013.01)

(58) Field of Classification Search

CPC ..... A42B 3/0426; A42B 3/046; A42B 3/30; G08B 25/016

See application file for complete search history.

(56) References Cited

U.S. PATENT DOCUMENTS

| | | | | |
|---|---|---|---|---|
| 9,445,639 | B1 * | 9/2016 | Aloumanis | A42B 3/0453 |
| 10,098,401 | B2 * | 10/2018 | Weller | A42B 3/0406 |
| 2003/0071766 | A1 | 4/2003 | Hartwell | |
| 2004/0143373 | A1 | 7/2004 | Ennis | |
| 2006/0048286 | A1 | 3/2006 | Donato | |
| 2008/0239080 | A1 | 10/2008 | Moscato | |

(Continued)

OTHER PUBLICATIONS

LiveMap:Motorbike helmet with GPS navigation. Bike HUD, https://www.youtube.com/watch?v=wCfjX-KEWmA&feature=youtu.be, Jun. 10, 2013.

(Continued)

*Primary Examiner* — Nader Bolourchi

(74) *Attorney, Agent, or Firm* — Dunlap Codding, P.C.

(57) ABSTRACT

A protective helmet is disclosed comprising a protective shell, a visor, two rearward-mounted imagers, a display, and a processing system. The protective shell has an opening in front that is selectively covered by the visor and is configured to fit about the head of a user. The two imagers are mounted in substantially fixed positions on the rear of the protective shell so as to collectively provide a view of greater than 180 degrees about the rear of the protective shell. The processing system is operably associated with the two imagers and the at least one display, which displays real-time video from at least the left-most of the two imagers, as well as real-time video from the right-most imager or navigation, positioning, audio entertainment, or telephone call information. The helmet may further include a multi-level proximity alert system, an impact emergency alert system, and rechargeable power system.

19 Claims, 10 Drawing Sheets

(56) References Cited

U.S. PATENT DOCUMENTS

| | | | | |
|---|---|---|---|---|
| 2009/0109292 | A1* | 4/2009 | Ennis | A42B 3/042 348/158 |
| 2011/0318197 | A1* | 12/2011 | Huber | F04D 25/0673 417/234 |
| 2012/0223833 | A1 | 9/2012 | Thomas | |
| 2013/0128046 | A1 | 5/2013 | Gindin | |
| 2013/0305437 | A1 | 11/2013 | Weller | |
| 2013/0311075 | A1 | 11/2013 | Tran | |
| 2015/0105035 | A1 | 4/2015 | De Oliveira | |
| 2015/0130945 | A1* | 5/2015 | Yu | H04N 7/181 348/158 |
| 2015/0228066 | A1 | 8/2015 | Farb | |
| 2015/0238143 | A1 | 8/2015 | Meurer | |

OTHER PUBLICATIONS

Nandlogic Smart Helmet—CES 2015, https://www.youtube.com/watch?v=eR64KbnYTVQ&feature=youtu.be, Jan. 8, 2015.

Fusar, This augmented reality motorcycle helmet could save your life, http://www.engadget.com/2014/05/30/augmented-reality-motorcycle-helmet/, May 30, 2014.

Terndrup, Matthew, Hands-on with DAQRI's New Industrial Augmented Reality Helmet, http://www.roadtovr.com/hands-daqris-new-industrial-augmented-reality-helmet/, Feb. 27, 2015.

Quick, Darren, FlyViz puts eyes in the back of your head, http://www.gizmag.com/flyviz-360-degree-view/25432/, Dec. 13, 2012.

Nuviz, https://www.kickstarter.com/projects/nuviz/the-first-head-up-display-for-motorcycle-helmets/description, Nov. 28, 2013.

* cited by examiner

PROTECTIVE HELMET

INCORPORATION BY REFERENCE

The present application claims the benefit of U.S. Provisional Patent Application No. 62/153,075 filed on Apr. 27, 2015 and U.S. Provisional Patent Application No. 62/264,738 filed on Dec. 8, 2015

FIELD OF THE INVENTION

The present disclosure is generally directed to a protective helmet with an integrated display, at least two rearward vision cameras, sensors, audio, and other experience enhancing features.

BACKGROUND ART

Motorcycle drivers, race car drivers, go-cart drivers, snowmobile drivers, bicycle riders, and others frequently wear a protective helmet on their heads to protect themselves from traumatic head injuries. While these protective helmets are great at protecting heads from sustaining the full impact in a collision, they may impede the wearer's ability to see (and perhaps even fully hear) potential danger approaching, particularly from behind.

Various prior art solutions to this problem have been proposed. For example, U.S. Patent Publication No. 2013/0305437 to Weller et al. teaches associating a single rearward-facing camera mounted to the back of a helmet providing the rider with real-time video via an integrated display system. The real-time camera disclosed in Weller is capable of viewing 150-200 degrees about the helmet. Weller teaches that the display is preferably mounted such that it appears to be "behind" the chin bar of the helmet to minimize obstruction of the rider's forward view of the road through the helmet opening. Weller '437 application also discloses that the display could be a heads-up display. The Weller '437 application further teaches that a forward-facing second camera may be operably mounted to the helmet along with additional sensors (such as accelerometers, scanning LIDAR, and/or radar). Finally, Weller '437 teaches the use of an air-powered electricity generating system to recharge the helmet's battery pack that powers the display, camera, and sensors.

Gindin, U.S. Patent Publication No. 2013/0128046 similarly discloses the use of a helmet mounted display and single video camera to provide views of "scenes not directly in the field of view of the viewer" by mounting the camera in a direction other than the direction of view of the user of the helmet. See ¶¶[0009] and [0012]. Other helmet mounted cameras are also taught in the prior art. For instance, U.S. Patent Publication No. 2008/0239080 to Moscato discloses a rear vision system having a single, head-mounted, rearward facing camera connected to a head-mounted display. De Oliveira, U.S. Patent Publication No. 2015/0105035 discloses a safety helmet with a forward-facing integrated camera powered by a battery charged by a photovoltaic device.

Farb, U.S. Patent Publication No. 2015/0228066 discloses the use of a rearward facing sensor (e.g. computer vision, infrared, radar, or video) mounted to a bicycle frame (as opposed to a helmet), to determine the distance and velocity of a vehicle approaching toward a bicycle rider from behind and alerting the rider if the vehicle is on a close collision course. In one embodiment, Farb teaches using two rearward facing cameras mounted on the bicycle "to provide stereo vision capability to enhance depth perception or the ability to determine the distance between the rear approaching vehicle" and the system. Farb, ¶[0181]. The alerting system—which is disclosed as being attached to the bicycle handlebar—may include multi-colored LEDs "where the colors indicated the likelihood of the impending collision," and/or an "audible alert that can pulse (beep) at different rates, provide an escalating sound level (dB) . . . in an escalating manner analogous with those described for the visual alerting system," see Farb, ¶¶[0080]-[0085]. Farb also teaches the availability of forward-facing video, GPS, and accelerometers as well as the determination of a crash event and the video recording of the vehicle that crashed into the system.

SUMMARY OF THE INVENTION

The prior art solutions fail to teach alone or in combination a protective helmet that provides a wide-field of rearward vision produced by the cooperation of multiple rearward facing cameras mounted in the helmet. The combination of these features in and of themselves would provide enhanced safety and functionality over the prior art solutions. In combination with additional sensor technology and alerting features, the combination would provide a higher level of safety and functionality. The addition of two display elements provides for additional functionality that can further improve the user experience.

Various aspects of these improvements and others that will become apparently to one of ordinary skill in the art after reading the present specification, reviewing the drawings, and considering the claims are provided by a protective helmet comprising a protective shell configured to fit about the head of a user, the protective shell having an opening, a top surface, and a back surface. The protective helmet further including a visor mounted to the protective shell such that the visor selectively covers at least a portion of the opening. The protective helmet further includes two imagers mounted in substantially fixed positions on the rear of the protective shell so as to collectively provide a view of greater than 180 degrees about the rear of the protective shell. The helmet must further include at least one display viewable by the user from within the interior of the protective shell and a processing system operably associated with the two imagers and the at least one display.

The helmet may further comprise at least one proximity sensor mounted on the rear of the protective shell and operably associated with the processing system; and a multi-level user-perceivable alert mechanism that alerts the user with a first signal when the at least one proximity sensor senses that an object is less than a first predetermined distance from the protective shell and a second signal when the at least one proximity sensor senses that the object is less than a second predetermined distance away from the protective shell. The multi-level human-perceivable alert mechanism may comprise two or more light emitting elements (e.g. LEDs) mounted in association with the protective shell such that they are visible to the user from within the interior of the protective shell, the processing system triggering the two or more light emitting elements to provide the first and second signals to the user. The multi-level human-perceivable alert mechanism may further include an audio speaker mounted in the protective shell, the processing system driving the speaker to provide the first and second signals to the user.

The helmet may comprise an impact sensor mounted in the protective shell and operably associated with the processing system and an emergency services alert system (ESAS) that contacts an emergency call center when the impact sensor senses at least a specified amount of force. Where the helmet includes a global positioning system, the emergency services alert system may also provide a present location of the helmet to the emergency call center when the impact sensor senses at least the specified amount of force. Where the helmet includes a microphone and a speaker, the emergency services alert system may further provide a substantially real time audio communication channel between the helmet and the emergency call center. To provide that communication channel, the emergency services alert system may connect with a radiotelephone in close proximity via Bluetooth or some other NFC technology. The helmet may use one or more batteries (preferably rechargeable) to operably power any or all of the two imagers, the at least one display, the processing system, the at least one proximity sensor, the impact sensor, and the ESAS. Preferably, the one or more batteries are capable of holding sufficient charge to run all of the electronics in the helmet for at least a few hours. In an approach where the batteries are rechargeable, the helmet may also further include a photovoltaic array mounted proximate to a portion of the top surface of the protective shell and operably connected to the battery.

The display associated with the helmet may include a left display element and a right display element. In this embodiment, the left display element would display real-time video from at least the leftmost rearward facing imager. In this embodiment, the right display element would display one video source selected from the group comprising real-time video from a rightmost imager of the two imagers, navigation information, positioning information, audio entertainment information, and telephone call information. The helmet may further include a switch that cycles through the video source options.

The display may comprise a projector projecting the left and right display elements onto an interior visor. It may alternatively be one discrete display substrate, which may also be movable within the protective shell. Where the display comprises at least one projector, the helmet projects the left and right display elements onto the interior visor. Alternatively, the display may comprise one discrete display substrate the helmet further comprising a system for moving the substrate within the protective shell.

DETAILED DESCRIPTION OF FIGURES

The general purpose of the present invention is to provide a new and improved protective helmet. Like all protective helmets, the present helmet (shown, e.g., in FIGS. 1-3) is designed to withstand impacts typically associated with serious motorcycle accidents. It is contemplated that the helmet and its many features may be useful in other environments where users (drivers and passengers) would benefit from the safety of a helmet, as well as the helmet's other enhanced features. Such environments could include, but are not limited to auto racing, go-cart driving, snowmobiling, downhill or cross-country skiing, bicycle riding, hang-gliding, and the like. The protective helmet is also preferably designed to be aerodynamic and lightweight for optimum performance, comfort, and style. In addition to providing impact protection and performance improvements for the user, the protective helmet is preferably manufactured in such a manner as to provide more defined support to its user.

The protective helmet is also part of a system that interacts with a software application that may be deployed on a smartphone, PDA, tablet and even a personal computer. As such, the protective helmet is also believed to provide a significant increase in safety for motorcycle riders by integrating one or more of the hardware and mobile application features described herein below.

Figure 1:
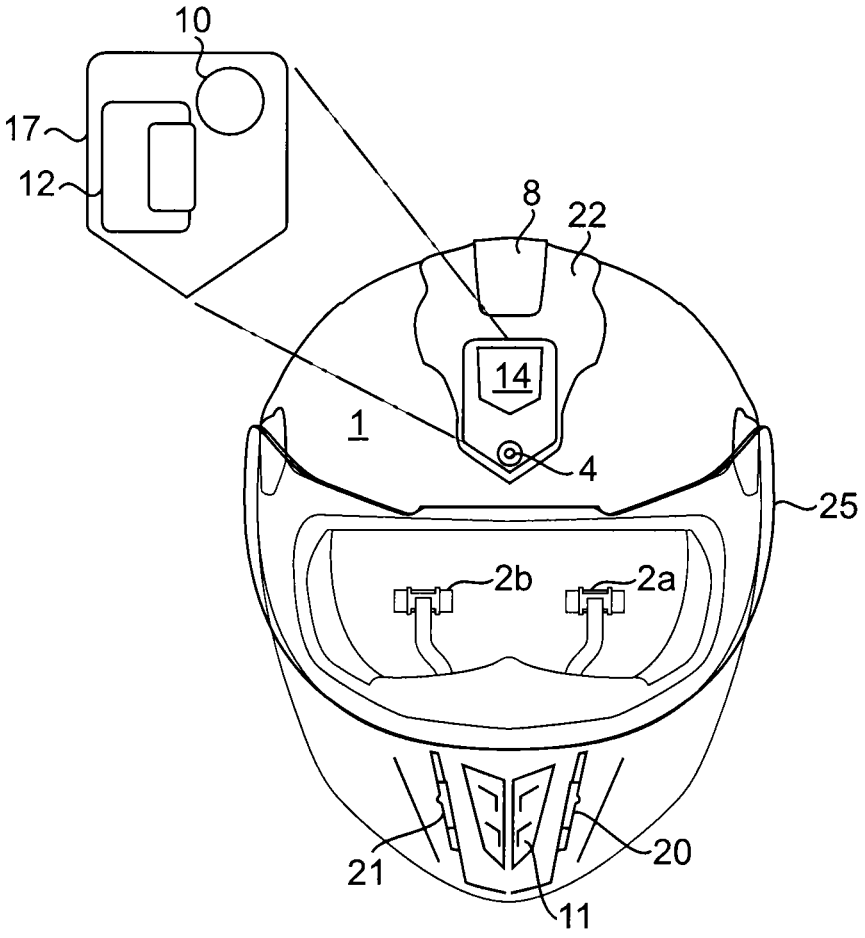
FIG. 1 is a front elevational schematic view of one potential embodiment of a protective helmet.

The helmet must include a protective shell (1) configured to fit about the head of a user, the protective shell having an opening, a top surface, and a back surface. The helmet further includes an external visor (25) mounted about the front opening in the protective shell (1) such that the external visor selectively covers at least a portion of the protective shell opening. In some embodiments, the external visor (25) may be tinted on command by activating the user-activated visor tinting system (14). Next, the helmet must also include two imagers (3 in FIG. 2) mounted in substantially fixed positions on the rear of the protective shell (1) so as to collectively provide a view of greater than 180 degrees about the rear of the protective shell. The helmet further includes at least one display (2) viewable by the user from within the interior of the protective shell (1). For example, FIG. 1 illustrates an embodiment with two tiltable heads-up displays formed on their own separate substrate and mounted to heads-up display movement arms (20), which are each independently adjustable in at least one plane. And finally, the helmet includes a processing system (17) operably associated with the rearward imagers (3) and the at least one display (2). The processing system (17) may also be operably associated with forward imager (4). The processing system is also operably associated with batteries (18).

Figure 2:
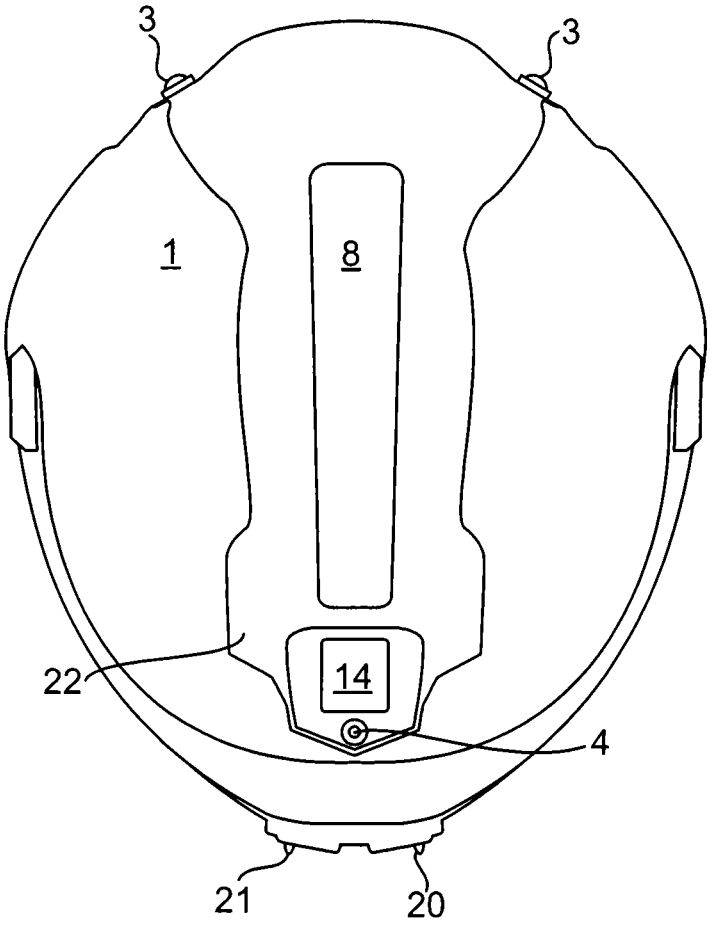
FIG. 2 is a top plan schematic view of the protective helmet of FIG. 1.
Figure 3:
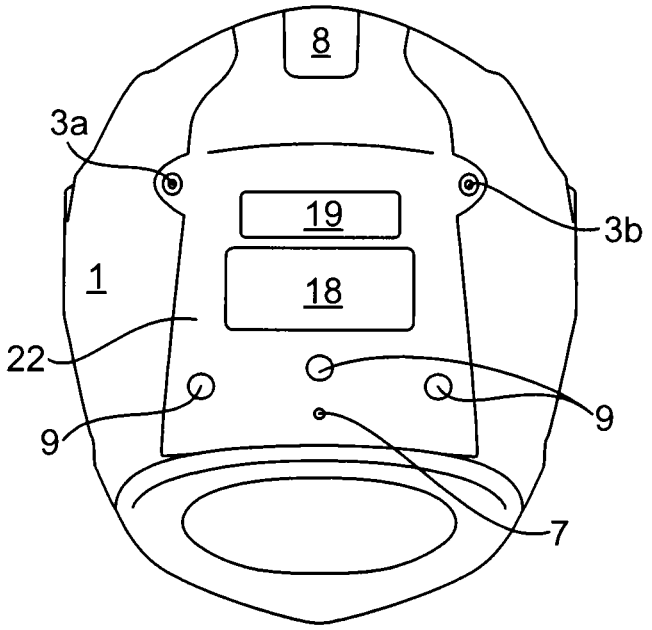
FIG. 3 is a rear perspective schematic view of the protective helmet of FIG. 1.
Figure 3A:
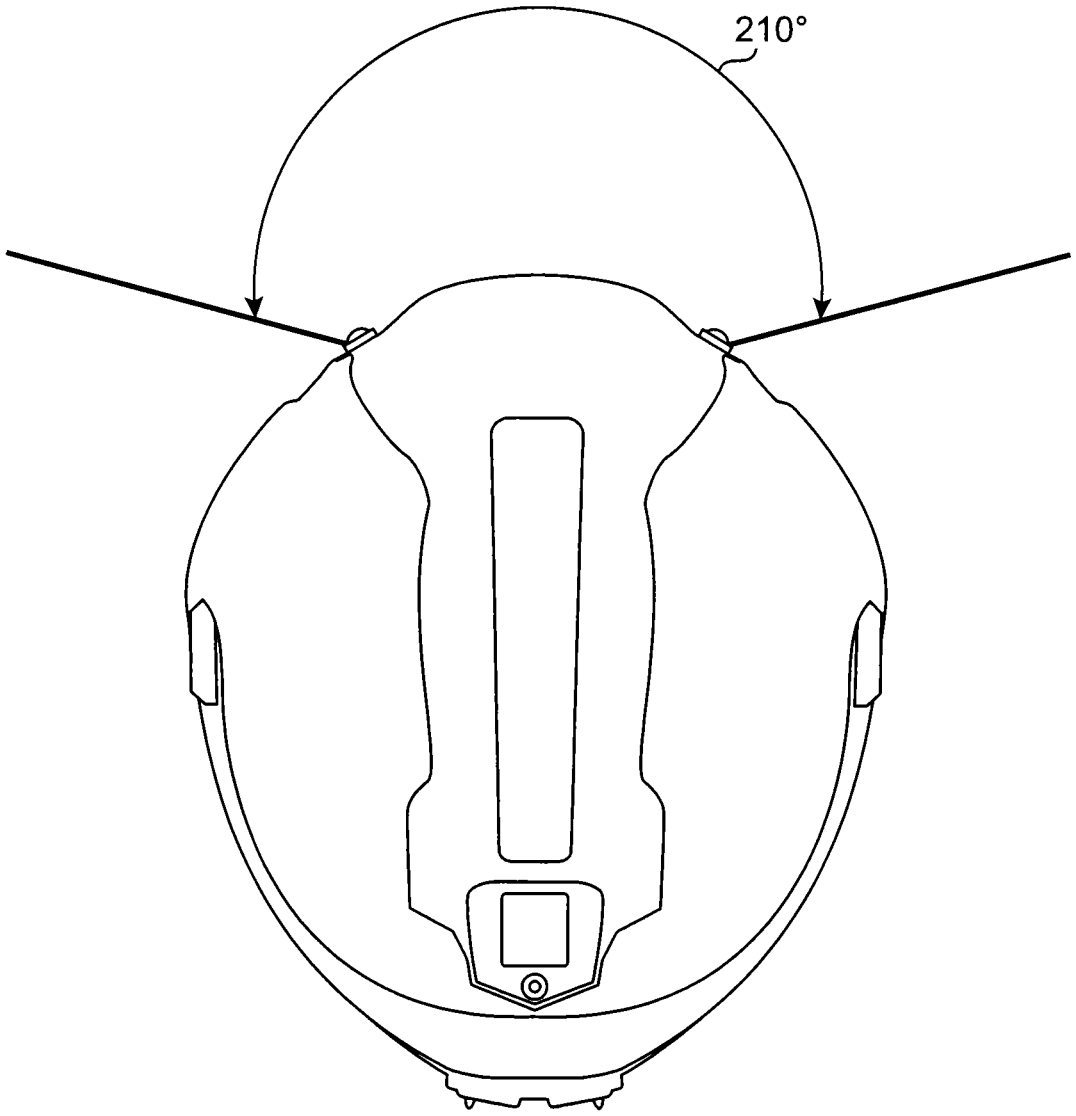
FIG. 3A is an illustration of the breadth of the scope of the preferred collective rear view imaging.

As shown in FIGS. 2 and 3, the two rear-view imagers (3) are fixedly mounted to the rear of the protective shell (1) in pre-determined locations such that they preferably provide a view of approximately 210 degrees or more to the rear of the helmet about its mid-point (as illustrated in FIG. 3A). While the resulting view generated by the two imagers may be as narrow as 180-209 degrees to the (depending upon reasonable helmet design choices), a wider range of rearward view is a primary goal of the present protective helmet. With this rear-view breadth, the video provided by the two rear-view imagers (3) to the at least one display (2) substantially negates commonly experienced blind-spots and removes the need for the user to take their eyes off the road ahead. The processing system (17) may provide video post processing to combine together the real-time videos captured by the separate rearward imagers (3) into a single panoramic image. However, it is preferred that the images being generated by each of the two rear-view imagers (3) be passed individually to a respective left and right display element, as will be discussed more fully below. As shown in FIGS. 1 and 2, the helmet may also include a front-view imager (4) fixedly mounted to the front of the protective shell. Each of rearward imagers (3) and front-view imager (4) may be CMOS-, CCD-based, or hybrid semiconductor imaging technology. Each imager may capture video anywhere from 1 megapixel (MP) to 60 MP (and greater) converted to any desirable video format (e.g. NTSC, PAL, Raw RGB, RGB) at a variety of desirable frame rates, resolutions, aspect ratios, etc. with the understanding that the higher the frame rate, resolution, etc. the more processor power, video buffers, and memory that would be required to support the imagers, which would lead to a higher overall system cost. The real-time video generated by the imagers (3, 4) may be post-processed by the processing system (17). The video feed produced by the front view and/or rear-view imagers may be recorded and/or live streamed via wireless transmission. Preferably, each of the imagers (3, 4) will utilize technology to provide the ability to operate during the day and at night to provide the user with complete functionality at all hours. In one embodiment, the imagers in combination with the at least one display and on-board software may also be used to capture and save photos or videos from one or more of the real-time video streams for later review.

Figure 4:
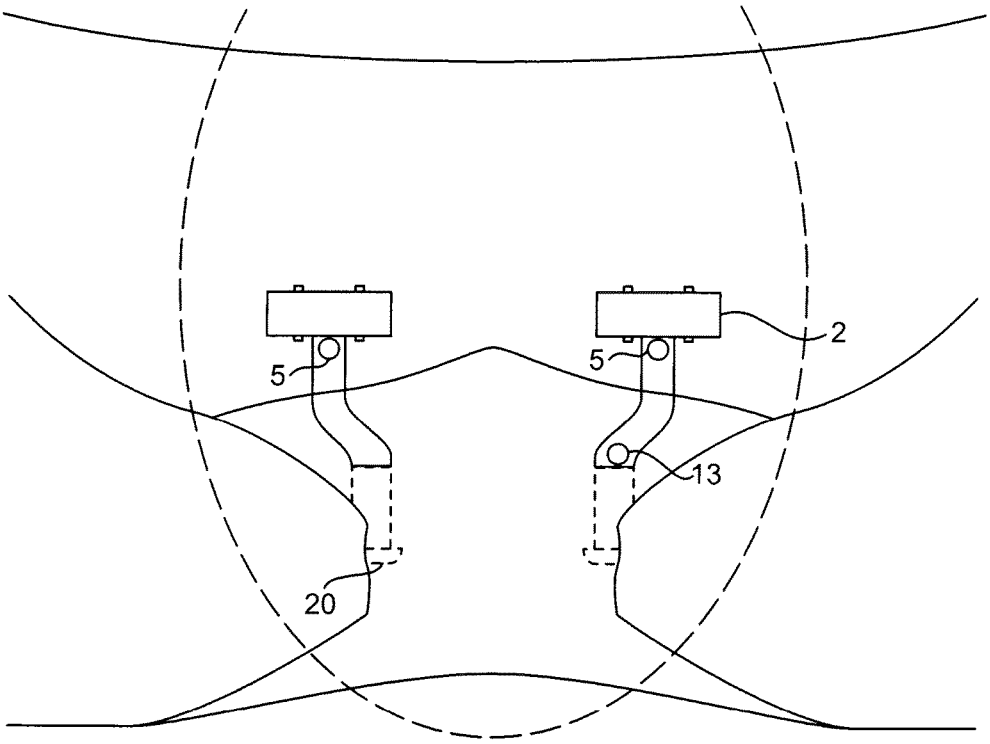
FIG. 4 is a schematic view of the interior of one potential embodiment of the protective helmet having two discrete heads-up displays (HUD) each formed on a substrate from the point of view of its user.
Figure 6:
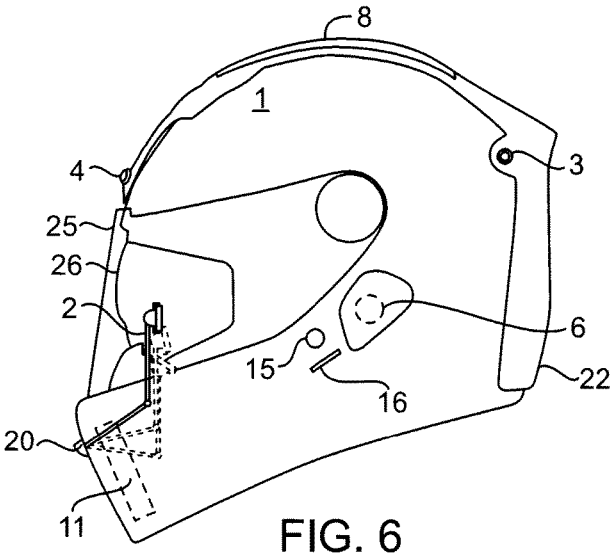
FIG. 6 is a side elevational schematic view of the protective helmet of FIG. 1.
Figure 4A:
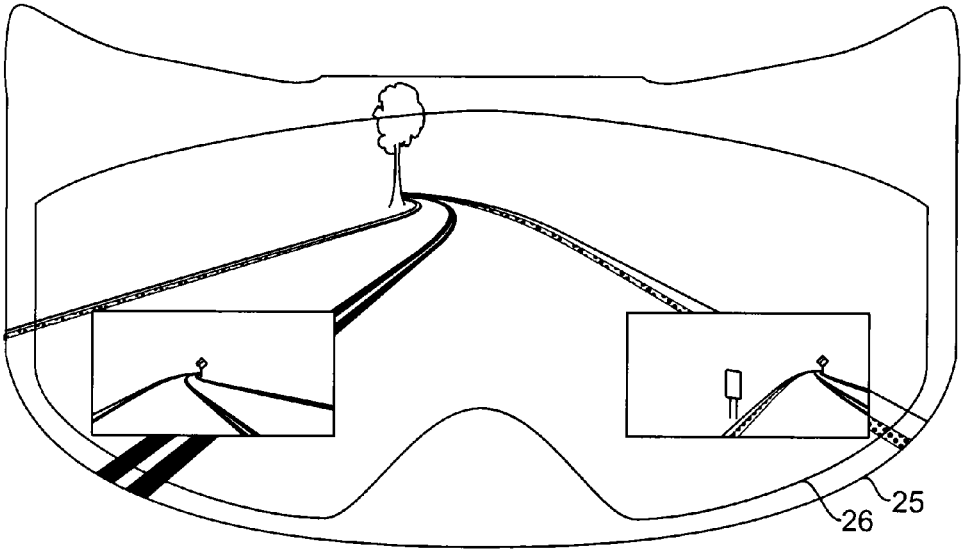
FIG. 4A is an illustration of the interior of the protective helmet of FIG. 4 wherein the right HUD is displaying a rear-looking video stream from the right imager and the left HUD is displaying a rear-looking video stream from the left imager.
Figure 4B:
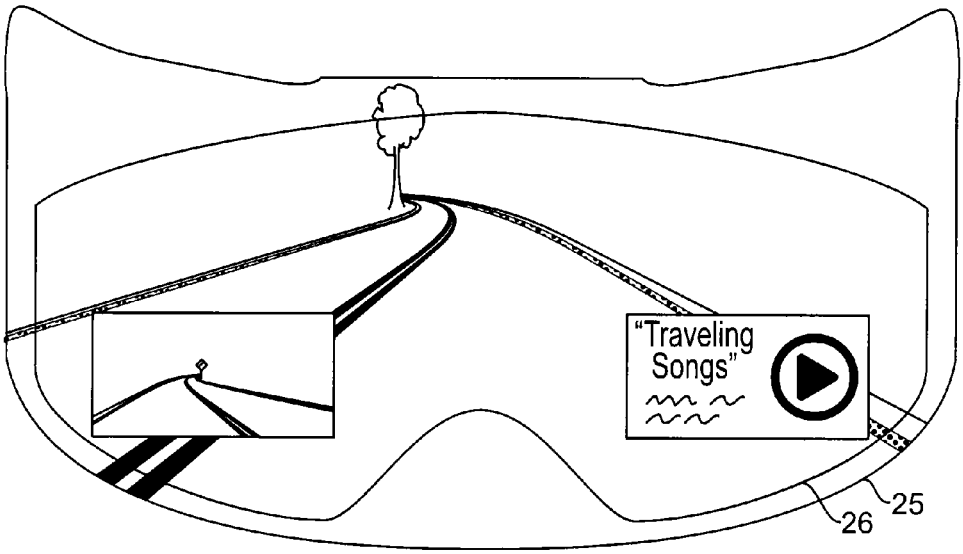
FIG. 4B is an illustration of the interior of the protective helmet of FIG. 4 wherein right HUD is displaying a rearward looking video stream from the right imager and the left HUD is displaying information about a music stream waiting to play over the audio system associated with the protective helmet.
Figure 4C:
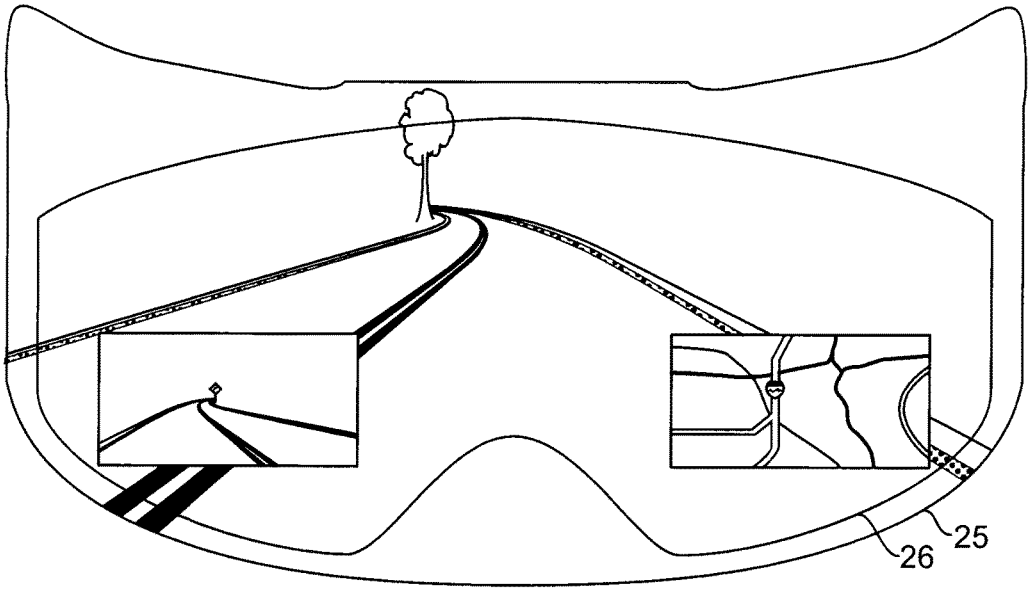
FIG. 4C is an illustration of the interior of the protective helmet of FIG. 4 wherein right HUD is displaying a rearward looking video stream from the right imager and the left HUD is displaying information from a computer application, such as a GPS, installed on a smart phone operably associated with the protective helmet.
Figure 4D:
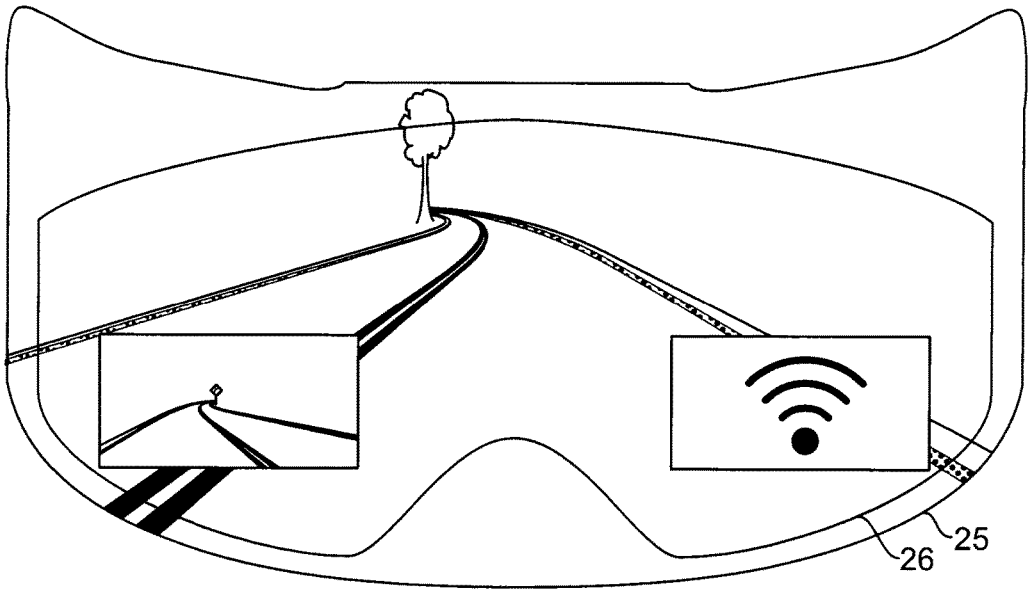
FIG. 4D is an illustration of the interior of the protective helmet of FIG. 4 wherein right HUD is displaying a rearward looking video stream from the right imager and the left HUD is displaying a symbol indicating that the protective helmet is wirelessly receiving data.
Figure 4E:
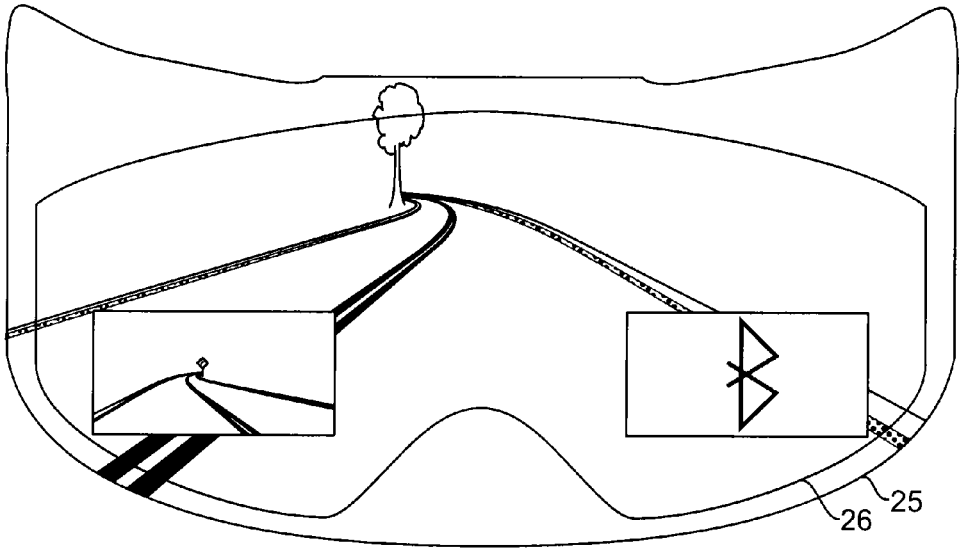
FIG. 4E is an illustration of the interior of the protective helmet of FIG. 4 wherein right HUD is displaying a rearward looking video stream from the right imager and the left HUD is indicating an alert or usage of the Bluetooth audio interface.

The at least one display (2) of the helmet may include a left display element (2*a*) and a right display element (2*b*). In this approach, the left display element may display the real-time video generated from the leftmost rear-view imager (3*a*) of the two imagers (3) fixedly amounted on the rear of the protective shell (1). The right display element (2*b*) may display video from one of the video source selected from the group comprising real-time video from the rightmost rearward imager (3*b*), navigation information (see FIG. 4C), positioning information, audio entertainment information (see FIG. 4B), and telephone call information. The helmet may further include a switch that cycles through the video source options that may be provided to the right display element (2*b*). The left and right display elements may comprise different or the same technology. In one approach, shown in FIGS. 4A-4E, a projector may be used to project the left and right display elements onto internal visor (26, FIG. 6). Of course, it is also possible to use two projectors, one for each image. The projector or projectors (depending upon the design) may be sourced from ImaginOptix of Cary, N.C. and/or Lumens Digital Optics based in Hsinchu, Taiwan. In both instances, the images will preferably be generated onto the internal visor (26), which may be coated with a particular material to facilitate display of the video. It is also contemplated that the projector(s) could be used in association with discrete substrates that may be mounted onto HUD movement arms (20, see, e.g., FIGS. 1, 4 and 6). Each projector would be operably associated with the processing system (17) and powered by the batteries (18).

Alternatively, each of the at least one displays (2) may be formed by a discrete display substrate, such as an OLED display. In one design using discrete display substrates, the at least one display could include two tiltable, transparent heads-up displays (2), but as would be understood by those of ordinary skill in the art having the present specification before them, the helmet may include only one heads-up display (2). Those skilled in the art would also understand in view of the present disclosure that while these heads-up displays may preferably be transparent substrates, it would also be possible to use translucent or even opaque substrates to form the displays used in association with the present invention so long as the substrates can be deployed in such a way as to not significantly obscure the driver's field of view while they are wearing the protective helmet. In this design approach, the helmet may further include a system or mechanism for moving the substrate within the protective shell. For instance, the heads-up displays (2) would be moved by a respective HUD Movement Arm (20). The discrete displays substrates (2) may be driven by display driver circuits operably associated with the processing system (17) and powered by the batteries (18).

Among other content that may be displayed on the at least one display is the real-time video stream from each of the two rearward-facing (3) or the one forward-facing imager (4) associated with the helmet. As noted above, the two rearward-facing camera images may be combined together, if desired, and then treated as a single image for display purposes. The at least one display may also display a graphical user interface (GUI) that contains status indicators and other graphics associated with helmet related functions including, but not limited to:

a. information (including received signal strength) for Bluetooth and other wireless connectivity to smart phones, other helmets, etc.;
b. battery level/charging status;
c. user profile;

d. day and/or night modes;
e. warning system settings;
f. solar power system status (e.g. receiving sun light, charging, etc.);
g. music information (e.g. source (AM, FM, SAT, MP3), song title, artist, time remaining);
h. In-phone call information (e.g. caller identification, elapsed time, received signal strength);
i. Listing common voice commands understood by the processing system (17);
j. Global Positioning System (GPS) navigation information (e.g. turn-by-turn directions, upcoming street, etc.);
k. weather reports;
l. telemetry data; and
m. visor tint control.

Figure 3B:
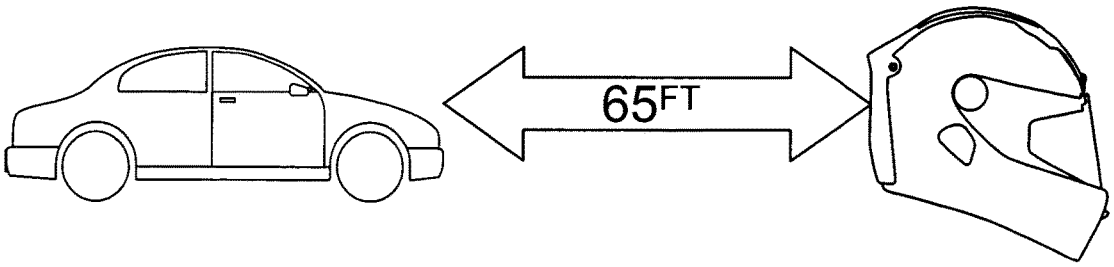
FIG. 3B is an illustration of the correlation between a first signal (e.g. a first flashing sequence of the LED lights in the protective helmet) and the proximity of an object (e.g. a vehicle) to the rear of the protective helmet.
Figure 3C:
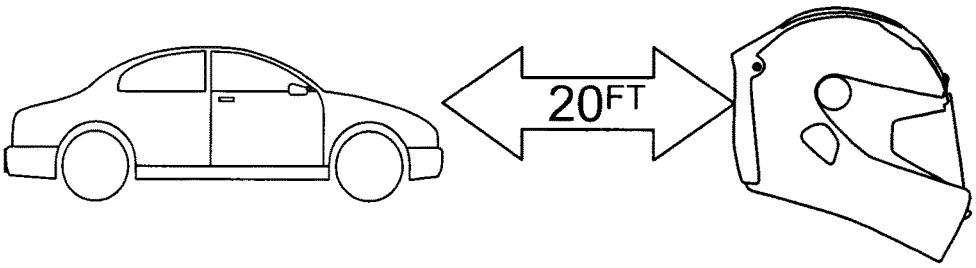
FIG. 3C is an illustration of the correlation between a second signal (e.g. a second flashing sequence of the LED lights in the protective helmet) and the proximity of an object (e.g. a vehicle) to the rear of the protective helmet.
Figure 3D:
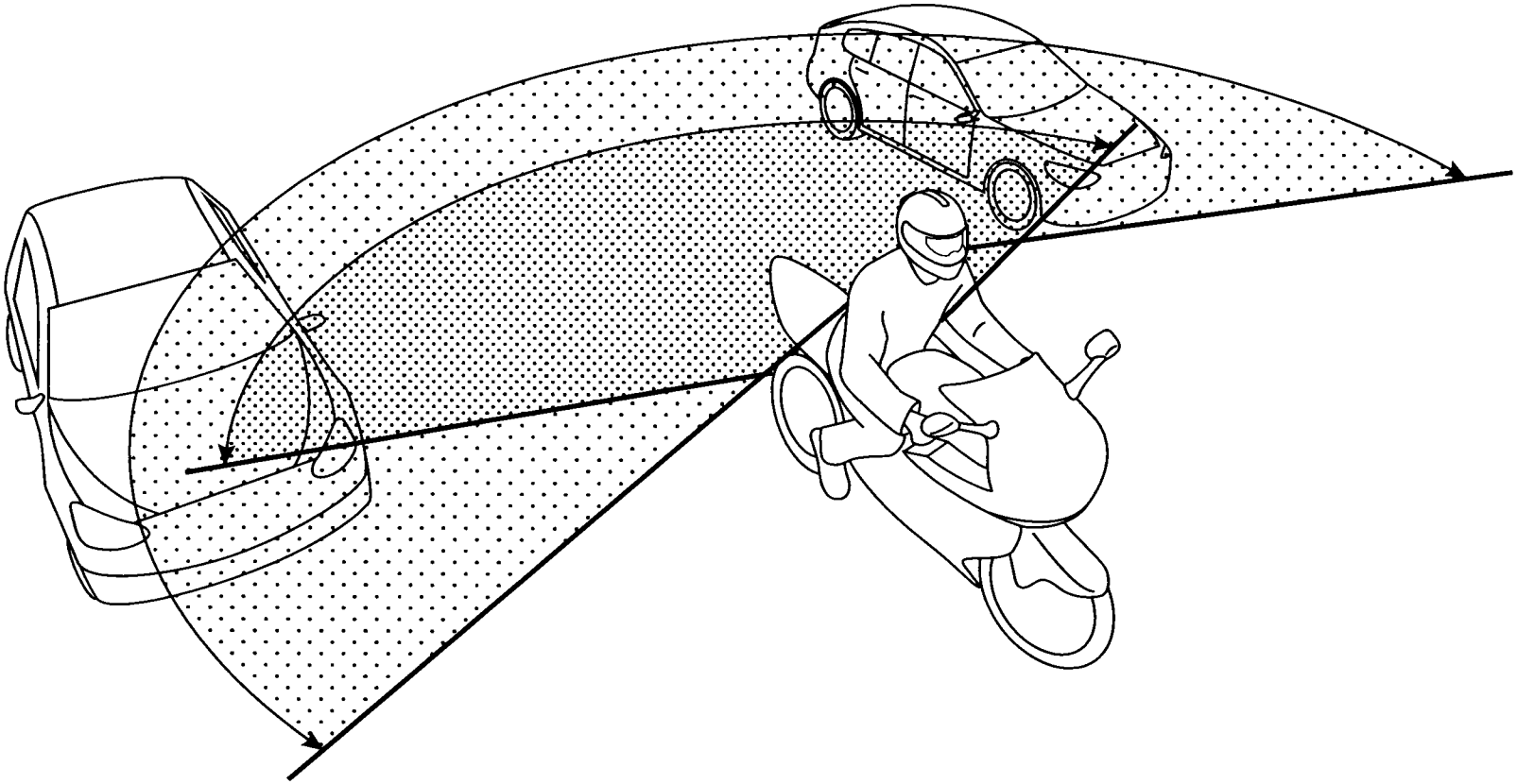
FIG. 3D is an illustration of scope of the rearward safety features in a preferred embodiment of the protective helmet.

As shown in FIG. 3, the helmet will preferably include at least one proximity sensor (9) mounted on the rear of the protective shell (1) and operably associated with the processing system (17) to provide early proximity warnings to the rider; to reduce the risk of potential accidents. As illustrated in FIGS. 3B, 3C, and 3D, the at least one proximity sensor would preferably be used to drive a multi-level, user-perceivable alert mechanism that alerts the helmet user with a first signal when the proximity sensor senses that an object (e.g. a vehicle) that is less than a first predetermined distance (e.g. 65 feet) from the protective shell and a second signal when the proximity sensor senses that the object is less than a second predetermined distance (e.g. 20 feet) away from the protective shell. The proximity sensors (9) may be one, or more preferably three, radar sensors. Each radar sensor may preferably be fixedly mounted to the rear of the protective shell attachment (22).

As illustrated in FIG. 1, the multi-level human-perceivable alert mechanism may include two or more light emitting elements (5) mounted in association with the protective shell such that they are visible to the user from within the interior of the protective shell. The processing system (17) in accordance with the distance sensed by the proximity sensors (9), the multi-level human-perceivable alert mechanism would trigger the two or more light emitting elements (5) to provide the first and second signals to the user. These light emitting elements (5) are preferably one or more LEDs and more preferably six LEDs. These LEDs preferably can generate at least two colors; preferably those colors may be amber and red. Amber and red are preferred colors because they are visible, and less likely to blind or distract a rider while on the road. In one example, a soft amber color could mean "warning," (i.e. the first signal) while a red color could mean "danger" (i.e. the second signal). The interior lights are driven by an LED driver circuit that preferably controls the amber and red lights to blink at specified speed intervals when a vehicle gets within a specified proximity of the helmet.

It may be desired to use the light emitting human-perceivable alert mechanism in tandem with a warning sounds system generated inside the helmet by speakers (6 (shown in FIG. 6)) mounted in association with the protective shell. The processing system would be used to drive the speakers to provide the first and second signals to the user depending upon the distance between the vehicle and the helmet. For instance, the first signal could be a chime at a longer interval than the second signal. With the idea being that the closer together the chime sounds, the closer the collision threat to the helmet. Other audio signals may be used and the end user may be provided with the ability to select the audible and visual signals triggered by the multi-level human-perceivable alert mechanism.

Figure 5:
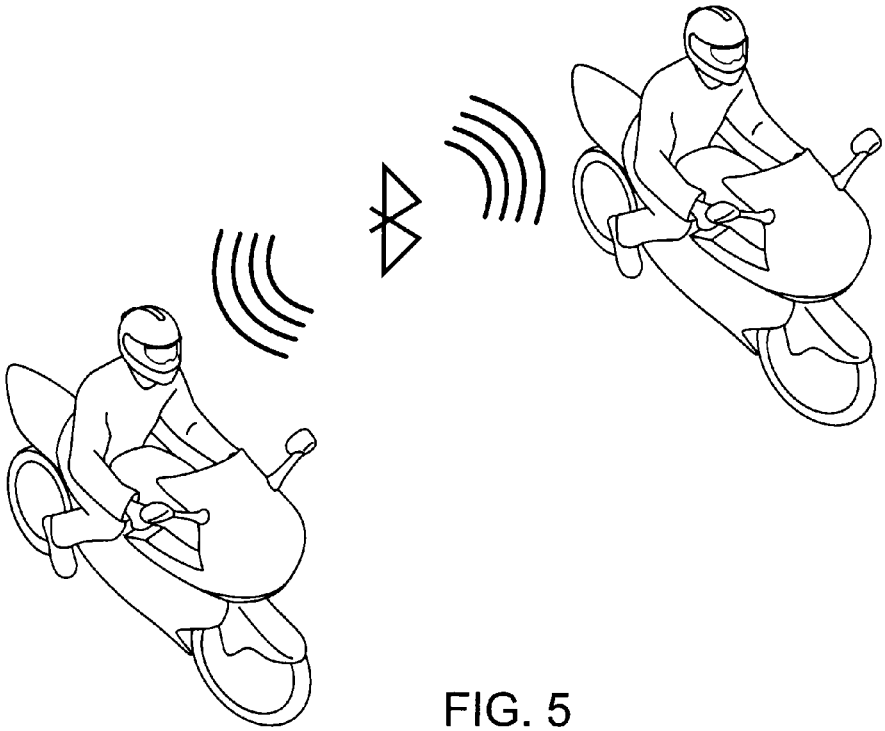
FIG. 5 is an illustration of one type of communication that may be facilitated in one embodiment of the protective helmet, Bluetooth Communications. As illustrated, communication may be facilitated directly between two users of the protective helmet in close proximity to one another.

FIGS. 3B and 3C illustrate potential relationships of a multi-level user-perceivable alert mechanism to potential threats. The mechanism alerts the user with a first signal when the proximity sensor(s) (9) sense that an object is less than a first predetermined distance (e.g. 65 feet) from the protective shell and a second signal when the proximity sensor senses that the object is less than a second predetermined distance away (e.g. 20 feet) from the protective shell. It should be readily understood by those of ordinary skill in the art having the present specification, drawings, and claims before them that the distances illustrated in FIGS. 5B and 5C are just one illustration of the system. It is contemplated that the end user may be able to set the distances for the first and second signal alerts based on user preference. It is also contemplated that the end user may choose to receive only visual warnings or only audible warnings. This is a matter of user choice.

The helmet may further include an Emergency Services Alert System (ESAS) (10), which work in tandem with the helmet hardware and software to provide emergency services when the protective helmet has been detected as being potentially involved in a significant collision. More particularly, the helmet may include an impact sensor mounted in the protective shell and operably associated with the processing system and an emergency services alert system (ESAS) that contacts an emergency call center when the impact sensor senses at least a specified amount of sudden force. So, when the helmet sensor sudden force in excess of a specified amount during a collision, the ESAS will automatically be triggered to contact an ESAS call center during that emergency and automatically send information about the motorcycle rider's GPS location to ESAS call centers. Where the helmet includes a speaker (6) and a microphone (13), the emergency services alert system (10) may further include a substantially real time audio communication channel between the helmet and the emergency call center. This real time audio communication channel may be established by a smart phone associated with the helmet, with the helmet connecting to the smart phone, which is presumed to be in close proximity to provide communications with the emergency call center. This near field communication could be Bluetooth-based or some other short distance communication technique.

The helmet may further include one or more interior speakers (6). These interior speakers are operably connected to system (via hardware and/or software) to provide the stage for audio notifications, streaming music, and mobile phone interaction. The helmet may include a user volume control (16) that allows the user to adjust the interior speaker volume, at will. The helmet may further include a haptic device to further alert the user.

The helmet may further include a user voice activation switch (15) that allows the user to provide actionable commands to the helmet's system. A microphone (13) may also be included to convert voice commands into electrical signals that may be used to operate the main functionality within the helmet, communicate with emergency services, telephone services, or other Bluetooth connected helmets.

The processing system (17) controls and manages the various processes used by the helmet (e.g. power management, user settings, proximity warnings, imaging, display, voice commands, audio, visor tinting). The processing system (17) preferably provides a Built-In-Test (BIT) feature to alert the user of system level problems. On-board memory (12) associated with the processing system may be used to save user level settings, system level caches and BIT errors.

The memory may also be used to store music for a music library for the rider's convenience.

The helmet may also include a one piece shell attachment (22). Where the one piece shell attachment is provided, the attachment (22) may encase the following hardware components and will be mounted on the motorcycle helmet shell: (a) two rear-view imagers (3); (b) front-view imager (4); (c) power port (7); (d) photovoltaic cells/array (8); (e) proximity sensors (9); (f) Emergency Services Alert System (ESAS) (10); (g) memory (12); (h) user activated visor tinting (14); (i) processing system (17); (j) batteries (18); and (k) smart battery electronics (19). One piece shell attachment (22) may be removed from protective shell (1) with the use of tools. As such, by encasing certain hardware components in the one piece shell attachment (22) it is contemplated that those components may be more easily upgraded or otherwise replaced while allowing reuse of any or all of the protective shell (1), display (2), HUD movement arms (20), and external visor (25). It would similarly be possible to replace or otherwise change the protective shell (1) while keeping all of the hardware components encased by attachment (22). One reason to change the shell may be to display different ornamental features in different circumstances.

As illustrated, batteries (18) sufficient to provide power to all of the systems associated with the helmet are preferably contained completely within the helmet. However, it is possible that the size and weight of the batteries could require that all or some of the batteries may be external to the helmet. The batteries (18) are preferably rechargeable. In which case, the helmet preferably includes smart battery electronics (19) that would be used to condition and dispense the internally stored power of the batteries (18) and also convert and store any energy collected by the photovoltaic cells (8) that may be located on the top of the protective shell. Additionally, these smart battery electronics (19) will provide information for the helmet-processing system (17) to calculate current battery levels. The helmet may also have a power port (7) integrated into the one-piece shell attachment (22) as the primary path for charging the helmet's rechargeable battery system. The smart battery electronics (19) may use external power (via the power port) or the solar power generated by the array/panel of photovoltaic cells (8). As noted, the solar power panel (8) may be built into the top of the one-piece shell attachment (22). Thus, the figures illustrate one potential configuration for a solar panel, with it being understood that the photovoltaic array may take any shape and be placed in other functional positions on the shell.

The helmet preferably also may include a front air vent movement arm (21), which allows the user to control the air flow into the helmet. The helmet may also further include a respiratory filter (11) operably associated with the front air vent that at least partially filters out air pollutants to allow the user to inhale fewer air pollutants. The respiratory filter is preferably a hardware replaceable insert. The helmet may further include a user activated visor tinting (14) that allows the user to tint or clear their external visor (25) on-demand.

The system may also include software that is disposed on a device that is physically separate from the helmet, such as a smartphone, PDA, remote control, and/or personal computer. The software would be used to support the helmet's various systems by providing a user interaction point that may provide one or more of the following functions:

a. The ability to change languages spoken by the processing system (17) via the speakers (6) inside the helmet;
b. The ability to build a "known circle" of Bluetooth connections for other rider's helmets;
c. The ability to connect to known wireless connections;
d. The ability to set day and night mode display brightness settings within the helmet;
e. The ability to save the default volume for the helmet;
f. The ability to enable/disable the helmet's proximity warning system;
g. The ability to upload music to the helmet;
h. The ability to stream GPS navigation commands to the helmet;
i. The ability to create a "speed dial" list for fast voice activation within the helmet;
j. Ability to save or stream the videos from the front view imager;
k. The ability to modify display color and layout themes for the helmet's graphical user interface (GUI); and
l. The ability to customize and save all the above features into well-organized user profiles.

Discussion of the Invention with Reference to One Embodiment

The present invention relates to a helmet embodying two tiltable and transparent heads-up displays (2) which also operate with a mobile operating system to display functionality of the mobile operating, as described above. Two LED interior lighting positions (5), Microphone (13); enabling the rider to utilize voice commands to operate the main functionality within the helmet, as well as communicate with ESAS (10). Interior speakers (6) provide sound and audio notifications to the rider. HUD movement arm (20), with the necessary mechanical support; which is a hardware component that controls the position & movement of the two tiltable and transparent displays.

A front-view imager (4) which works in tandem with helmet hardware components and mobile OS to provide the rider the ability to record and/or live stream their video feed from their motorcycle helmet. The front view imager (4) will also have the ability to operate during the day and during the low light night conditions. Two rear-view imagers (3) which are strategically mounted to the back of the helmet, interlaced, and work to preferably provide at least 210 degrees of rearward view negating the rider's common blind-spots; removing the need for the rider to take his or her eyes off the road ahead. The imagers will have capability to operate in day mode or in the enhanced night mode where the images will be enhanced during low light conditions. Three proximity sensors (9) may be integrated into the rear of the protective shell (1) work to provide early proximity warnings to the rider to reduce the risk of a potential accident(s). ESAS (10) which works in tandem with the helmet hardware components and mobile OS to provide emergency services when a motorcycle riders helmet has been detected as being involved in a severe collision. When the motorcycle helmet receives a specified amount of force during a collision, the ESAS will automatically be triggered and contact the ESAS call centers during that emergency and automatically send information about the motorcycle riders GPS location.

LIST OF COMPONENT HARDWARE FOR A POTENTIAL EMBODIMENT OF THE PROTECTIVE HELMET APPARATUS AND SYSTEM

1: protective shell
2: display
3: rear-view or rearward imagers
4: front-view imager

5: light emitting elements (e.g. LEDs)
6: audio speakers
7: power port
8: array of photovoltaic cells/panel
9: proximity sensors (e.g. radar)
10: Emergency Services Alert System (ESAS)
11: respiratory filter
12: memory
13: microphone
14: user activated visor tinting
15: user voice activation button
16: user volume control
17: processing system
18: batteries
19: smart battery electronics
20: HUD movement arms
21: front air vent movement arm
22: one-piece shell attachment
25: external visor
26: internal visor Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Although the invention has been explained in relation to its preferred embodiment, it is to be understood that many other possible modifications and variations can be made without departing from the spirit and scope of the invention.

What is claimed is:

1. A helmet comprising:

a protective shell configured to fit about the head of a user, the protective shell having an opening, a top surface, and a back surface;

a visor mounted to the protective shell such that the visor selectively covers at least a portion of the opening;

two imagers mounted in substantially fixed positions on the rear of the protective shell so as to collectively provide a view of greater than 180 degrees about the rear of the protective shell;

at least one display viewable by the user from within the interior of the protective shell;

a processing system operably associated with the two imagers and the at least one display;

at least one proximity sensor mounted on the rear of the protective shell and operably associated with the processing system; and a multi-level user-perceivable alert mechanism that alerts the user with a first signal when the at least one proximity sensor senses that an object is less than a first predetermined distance from the protective shell and a second signal when the at least one proximity sensor senses that the object is less than a second predetermined distance away from the protective shell.

2. The helmet of claim 1, wherein the multi-level user-perceivable alert mechanism includes two or more light emitting elements mounted in association with the protective shell such that they are visible to the user from within the interior of the protective shell, the processing system triggering the two or more light emitting elements to provide the first and second signals to the user.

3. The helmet of claim 2 wherein the multi-level user-perceivable alert mechanism further includes a speaker mounted in association with the protective shell, the processing system driving the speaker to provide the first and second signals to the user.

4. The helmet of claim 1 further comprising:

an impact sensor mounted in the protective shell and operably associated with the processing system; and an emergency services alert system (ESAS) that contacts an emergency call center when the impact sensor senses at least a specified amount of force.

5. The helmet of claim 4 further including a global positioning system, the emergency services alert system providing a present location of the helmet to the emergency call center when the impact sensor senses at least the specified amount of force.

6. The helmet of claim 5 further including a microphone and a speaker, the emergency services alert system further providing a substantially real time audio communication channel between the helmet and the emergency call center.

7. The helmet of claim 6 wherein the emergency services alert system connects with a radiotelephone in close proximity to provide communications with the emergency call center.

8. The helmet of claim 4 further comprising a rechargeable battery operably powering the two imagers, the at least one display, the processing system, the at least one proximity sensor, the impact sensor, and the ESAS.

9. The helmet of claim 8 further comprising a photovoltaic array mounted proximate to a portion of the top surface of the protective shell and operably connected to the rechargeable battery.

10. The helmet of claim 1, wherein the at least one display includes a left display element and a right display element, the left display element displaying real-time video from a leftmost imager of the two imagers.

11. The helmet of claim 10 wherein the right display element displays one video source selected from a group comprising real-time video from a rightmost imager of the two imagers, navigation information, positioning information, audio entertainment information, and telephone call information.

12. The helmet of claim 11 further including a switch that cycles through the video source options selected from the group comprising real-time video from a rightmost imager of the two imagers, navigation information, positioning information, audio entertainment information, and telephone call information.

13. The helmet of claim 11 wherein the at least one display comprises at least one projector projecting the left and right display elements onto an internal visor.

14. The helmet of claim 11 wherein the at least one display comprises one discrete display substrate the helmet further comprising a system for moving the substrate within the protective shell.

15. The helmet of claim 10 wherein the at least one display comprises at least one projector projecting the left and right display elements onto an internal visor.

16. The helmet of claim 1, wherein the at least one display comprises one discrete display substrate the helmet further comprising a system for moving the substrate within the protective shell.

17. The helmet of claim 1 further comprising:

an impact sensor mounted in the protective shell and operably associated with the processing system; and an emergency services alert system (ESAS) that contacts an emergency call center when the impact sensor senses at least a specified amount of force.

18. The helmet of claim 17 further including a global positioning system, the emergency services alert system providing a present location of the helmet to the emergency call center when the impact sensor senses at least the specified amount of force.

19. The helmet of claim 18 further including a microphone and a speaker, the emergency services alert system further providing a substantially real time audio communication channel between the helmet and the emergency call center.

* * * * *